US007018509B2

(12) United States Patent
Kilgannon et al.

(10) Patent No.: US 7,018,509 B2
(45) Date of Patent: Mar. 28, 2006

(54) ELIMINATION OF ALUM YELLOWING OF ASPEN THERMOMECHANICAL PULP THROUGH PULP WASHING

(75) Inventors: Robin R. Kilgannon, New City, NY (US); Robert J. Kane, Sartell, MN (US); Eileen M. Joy, Armonk, NY (US); Anil K. Dewan, Monroe, NY (US)

(73) Assignee: International Paper Co., Stamford, CT (US)

( * ) Notice: Subject to any disclaimer, the term of this patent is extended or adjusted under 35 U.S.C. 154(b) by 305 days.

(21) Appl. No.: 10/233,141

(22) Filed: Aug. 31, 2002

(65) Prior Publication Data

US 2004/0040679 A1 Mar. 4, 2004

(51) Int. Cl.
*D21B 1/16* (2006.01)

(52) U.S. Cl. ..... 162/24; 162/25; 162/79; 162/83; 162/60; 162/49; 241/15; 241/19

(58) Field of Classification Search ..... 162/25, 162/24, 79, 83, 60, 49; 241/15, 19
See application file for complete search history.

(56) References Cited

U.S. PATENT DOCUMENTS

| | | | | |
|---|---|---|---|---|
| 3,388,037 | A * | 6/1968 | Asplund et al. | 162/23 |
| 3,919,041 | A * | 11/1975 | Wilder | 162/25 |
| 4,810,328 | A * | 3/1989 | Freis et al. | 162/60 |
| 5,405,498 | A * | 4/1995 | Pease | 162/60 |
| 5,415,734 | A * | 5/1995 | Backlund et al. | 162/40 |
| 5,464,502 | A * | 11/1995 | Pease | 162/60 |
| 5,601,921 | A * | 2/1997 | Eriksson | 428/389 |
| 5,607,546 | A * | 3/1997 | H oglund et al. | 162/25 |
| 6,511,579 | B1 * | 1/2003 | Edwards et al. | 162/111 |

* cited by examiner

*Primary Examiner*—Mark Halpern
(74) *Attorney, Agent, or Firm*—Thomas W. Barnes, III

(57) ABSTRACT

This invention relates to an improved process for manufacturing bleached thermomechanical aspen pulp having reduced yellow after treatment with aluminum based chemicals such as alum which are used in paper making processes. In this improved process the pulp is washed prior to, after or between the bleaching stages or a combination of the foregoing.

20 Claims, 2 Drawing Sheets

10
12
14
16
18
20
22
24
26
28
30
32
34
36
38
40
42
44
46
48
50
52
54
56
58
60
62
64
66
68
70
72

ELIMINATION OF ALUM YELLOWING OF ASPEN THERMOMECHANICAL PULP THROUGH PULP WASHING

BACKGROUND OF THE INVENTION

1. Field of the Invention

This invention relates to the field of thermomechanical, bleached pulp and paper formed from such pulp. More particularly, this invention relates to the field of thermomechanical, bleached aspen wood pulp having reduced yellowing and increased brightness, and to processes of using such pulp in the fabrication of paper where aluminum based wet end chemicals such as alum, sodium aluminate, poly aluminum chloride, poly aluminum silicate sulfate are used as wet end additives.

2. Prior Art

Thermomechanical pulping processes are known. In these processes, wood chips are steamed for a short period of time after which the steamed chips are introduced into the open lip of a mechanical refiner. In the refiner, the wood chips are ground between rotating grooved metal discs. As the wood mass moves from the center of the refiner to the periphery of the refiner, the wood is broken down into progressively smaller particles and finally into fibers. Frequently, both the heating and refining stages are done under pressure; chemical treatments prior to refining or during the heating stage are further modifications to these pulping systems.

Thermomechanically produced pulps tend to be dark and require bleaching to reach the desired level of brightness. Various types of bleaching agents are used. For example, oxidative bleaching agents such as hydrogen peroxide and reductive bleaching agents such as sodium hydrosulfite (also called sodium dithionite) or formamidine sulfinic acid optionally in the presence of additives such as sodium tripolyphosphate (STPP), trisodium nitrilotriacetate, diethylene amino pentaacetate (DTPA), and ethylenediamine tetra acetate (EDTA) are used.

The bleached pulp is then formed into a paper making stock furnish of the desired consistency to which is added a wide range of chemicals or "wet end additives" to impart or enhance specific sheet properties or to improve the process for formation of the sheet. Wet end additives normally used in paper production are aluminum based additives such as alum, sodium aluminate, poly aluminum silicate sulfate and poly aluminum chloride. These additives are used as aids for retaining the wood fiber on the paper forming wire, to fix additives to the fiber surface and to control pH. However, although of great benefit in the production of paper, these aluminum based additives adversely affect the quality of thermomechanical bleached aspen pulp by causing the pulp to yellow. To offset thermomechanical bleached aspen wood pulp yellowing, dyes are used in the wet end of the paper making machine to give the final sheet a blue shade which in turn makes it look whiter. These dyes adhere to fiber fines, giving them a darker appearance. When these darkened fines are recirculated to the head box, they lower the brightness of the sheet. Optical brightness and bleaching agents are then needed to increase brightness to meet sheet specifications. The processes of this invention obviate one or more disadvantages of the prior art processes.

SUMMARY OF THE INVENTION

One aspect of this invention relates to an improved process for forming bleached thermomechanical aspen wood pulp of the type comprising:

(a) a thermomechanical refining stage wherein aspen wood chips are thermomechnically refined to form thermomechanical refined aspen wood pulp; and (b) a bleaching stage wherein said thermomechanical refined aspen wood pulp is bleached in one or more bleaching stages to form a first bleached thermomechanical refined aspen wood pulp;

the improvement comprising a washing stage subsequent to said thermomechanical refining stage (as for example prior to, between or after said bleaching stages, or a combination thereof) wherein said thermomechanical refined aspen wood pulp, bleached thermomechanical refined aspen wood or a combination thereof is washed at least once with an aqueous liquid composition, wherein on subsequent treatment of said bleached thermomechanical refined aspen wood pulp with at least one aluminum based chemical said first bleached thermomechanical refined aspen wood pulp has a higher ISO brightness than a second bleached thermomechanical aspen wood pulp formed by the same or substantially the same process as said first bleached thermomechanical refined aspen wood pulp in the absence of said washing stage.

Another aspect of this invention relates to the first bleached aspen wood pulp formed by the pulp and bleaching process of this invention.

Yet another aspect of this invention relates to an improved pulping and paper making process of the type comprising:

(a) a thermomechanical refining stage wherein aspen wood chips are thermomechanically refined to form thermomechanical refined aspen wood pulp, (b) a bleaching stage wherein said thermomechanically refined aspen wood pulp is bleached in one or more bleaching stages to form bleached thermomechanical refined aspen wood pulp, (c) a furnish forming stage wherein an aqueous paper making stock furnish comprising said bleached thermomechanical refined aspen wood pulp and one or more aluminum based chemicals is formed;

(d) a furnish depositing stage wherein said furnish is deposited on a forming wire of a paper making machine to form a wet paper web; and (e) a wet paper web drying stage wherein said wet paper web to form a first dried paper web, the improvement comprising a washing stage subsequent to said thermomechanical refining stage wherein said thermomechanical refined aspen wood pulp, bleached thermomechanical refined aspen wood or a combination thereof is washed at least once with an aqueous liquid composition, wherein said first dried paper web has a higher ISO brightness than a second dried paper web formed by the same or substantially the same process as said first dried paper web in the absence of said washing stage.

Still another aspect of this invention relates to the paper web formed by the pulping and paper making process of this invention.

DESCRIPTION OF THE PREFERRED EMBODIMENTS

Figure 1:
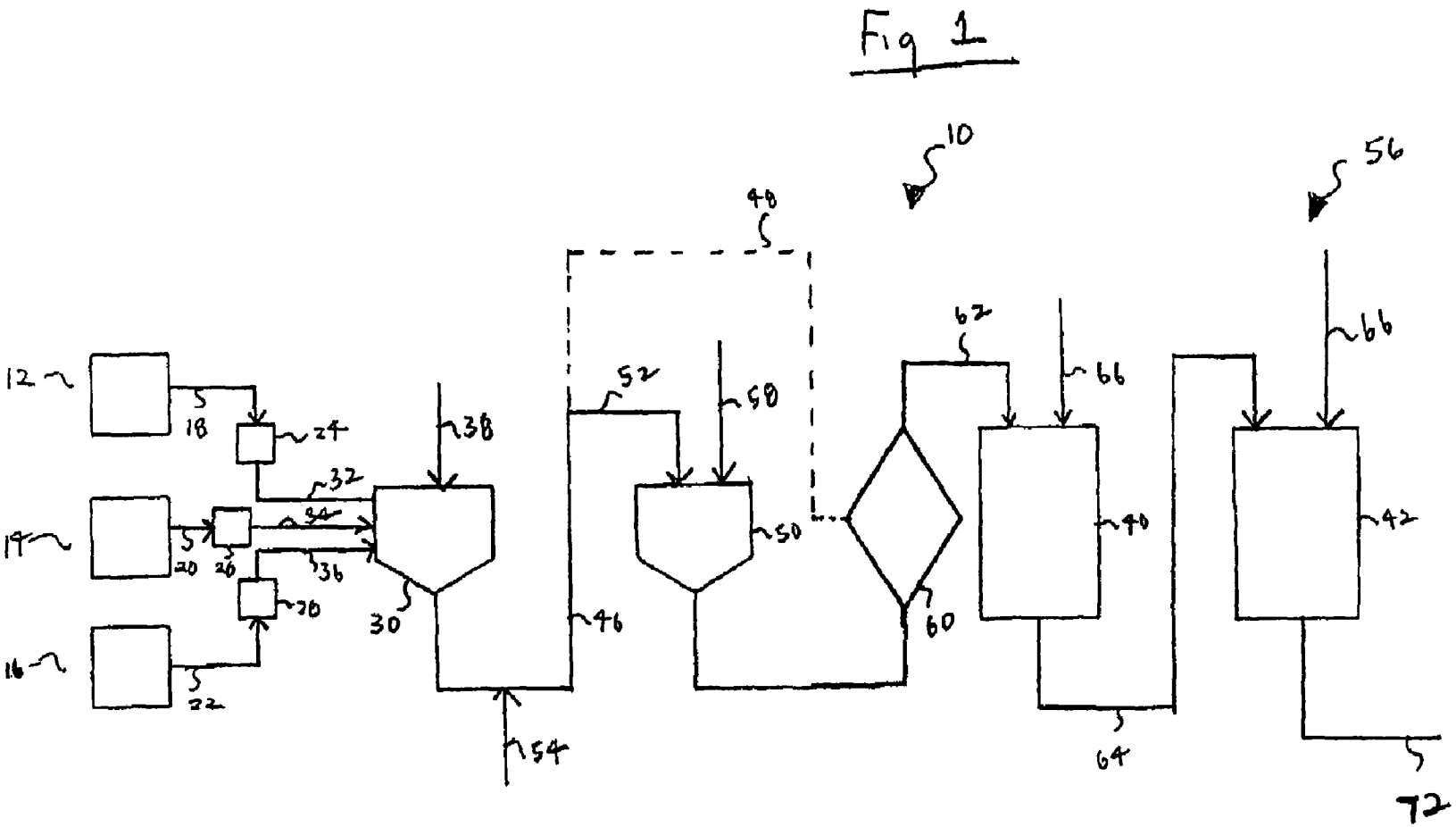
FIG. 1 depicts schematically a preferred pulp forming process of this invention.

In the first step of the process of this invention, aspen wood pulp is thermomechanically refined to form a thermomechanical refined aspen wood pulp. As used herein, "aspen wood pulp" or "aspen pulp" is pulp derived from wood species in the populus family which is prone to pulp yellowing, such as aspen.

Any conventional thermomechanical refining process can be used. Illustrative of useful processes are those described in U.S. Pat. Nos. 5,129,987; 3,388,037; 3,467,574; 3,804,944; 3,985,674; 4,534,954; 4,676,961; 4,756,799; 4,235,665; 4,136,831; 4,012,279; 3,847,363; 3,661,320; 3,873,412 and the like. Useful thermomechanical pulping apparatus can be obtained commercially from Andritz-Sprout-Bauer, Tampella, and Sunds Defibrator.

In the second step of the pulp forming process of this invention, the thermomechanical refined aspen wood pulp is washed. The washing step is critical for the unique advantages of this invention. Surprisingly, applicants have discovered that washing the thermomechanical refined aspen wood pulp prior to bleaching provides a bleached thermomechanical aspen pulp, and consequently paper formed from the aspen pulp, which have reduced yellowing when treated with aluminum based chemicals as compared to thermomechanically refined aspen pulp which has not been washed at this critical point in the process. The method used in washing the pulp is not critical and any conventional washing procedure and apparatus can be used. Illustrative of suitable washing apparatus are deckers, disk filters, screw presses and sidehill screens. Preferred washing apparatus are deckers because they provide the most dilution. The foregoing and other suitable washing apparatus can be obtained commercially as for example from Dorr Oliver, Andritz-Sprout-Bauer and the like.

In the preferred embodiments of the invention, the pulp is washed with fresh water if possible. Otherwise a clean source of recirculated water from the paper machines may be an acceptable compromise.

The thermomechanically refined aspen pulp is washed under conditions sufficient to reduce the yellowing of the pulp to any extent when it is exposed to aluminum based chemicals. The reduction in yellowing is shown by differences in the ISO brightness of the pulp. That is the greater the ISO brightness value the greater the reduction in pulp yellowing. In general, the ISO brightness of the washed aspen wood pulp is at least about 1.0 ISO brightness units greater than the ISO brightness of the unwashed aspen wood pulp formed under substantially the same process conditions in the absence of the washing stage. Preferably the difference in ISO brightness value is preferably at least about 1.5 ISO brightness units, more preferably at least about 2.0 ISO brightness units and most preferably at least about 3.0 ISO brightness units. In the embodiments of choice, the difference in ISO brightness values is from about 1.0 to about 4.5 ISO brightness units, or from about 2.0 to about 4.0 ISO brightness units.

Washing times may vary widely. In general, the longer the washing time the more effective the washing stage. Usually the aspen wood pulp will be washed for at least about 3 minutes. It is preferred to wash the aspen wood pulp for at least about 5 minutes. Amount of aqueous washing composition used may vary widely.

The amount of aqueous washing composition used may very widely. Usually, sufficient aqueous washing composition is used to form a wash mixture of aspen wood pulp and composition having a consistency of at most about 10% before the thickening stage. The consistency of the wash mixture is preferably equal to or less than about 5%.

The temperature at which the thermomechanically refined pulp is washed may also vary widely. Preferably, the pulp is washed at temperature from about room temperature (about 68° F. to 77° F.) up to about the boiling point of water. For example, the pulp can be washed at temperatures as high as about 212° F. and higher and as low as about 68° F. and lower. Preferred washing temperatures are from about 68° F. to about 200° F., more preferred washing temperatures are from about 80° F. to about 180° F. and most preferred washing temperatures are from about 90° F. to about 170° F.

After washing, the washed aspen pulp is bleached. Any conventional bleaching chemical can be used either individually or in combination, in a single bleaching or in two or more bleaching stages, alone or in combination with other chemicals such as quaternary compounds which enhance the bleaching effectiveness. Such useful bleaching chemicals include reducing agents such as sodium hydrosulfite or formamidine sulfinic acid (FAS) optionally in the presence of additives such as sodium tripolyphosphate (STPP), trisodium nitride triacetate, diethylene triamine pentaacetate (DTPA) and ethylene diamine tetraacetate (EDTA). Useful bleaching chemicals also include oxidative agents such as hydrogen peroxide with additives. Preferred bleaching chemicals are hydrogen peroxide and sodium hydrosulfite, either individually in a single bleaching stage or in a series of bleaching stages.

General descriptions of bleaching methods and bleaching chemicals for wood pulp made by mechanical processes may be found in the literature. See for example "Pulp and Paper Manufacture", The Pulping of Wood", Vol. 1, 2$^{nd}$ Edition, Ronald G. MacDonald Editor (McGraw-Hill Book Company) ("Pulp and Paper Manufacture") and Pulp and Paper, Chemistry, Chemical Technology, 3$^{rd}$ Edition, Vol. II., James Casey Editor; John Wiley & Sons ("Pulp and Paper Chemistry") and Pulp Bleaching Principles and Practice, by Carlton W. Dence and Douglas W. Reeve, SAPPI Press (1996) ("Pulp Bleaching"). These methods are known in the art. Consequently, these methods will not be described in great detail.

For pulp bleached with hydrogen peroxide, the typical amount of hydrogen peroxide which is applied is in a dosage range of about 0.5% to about 5% (of a 50% solution of hydrogen peroxide) based on the weight of oven dried pulp, with a preferred dosage being about 2% to about 3%. The usual initial pH range for bleaching with hydrogen peroxide is about 9.5 to about 11.5, with a preferred pH of 10.5. Typically, bleaching is conducted at a temperature about 50 to about 70° C., with a preferred temperature being about 60° C., and with a retention time of about 60 to about 300 minutes, with a preferred retention time being about 120 minutes.

By way of example, sodium hydrosulfite (also called sodium dithionite) may be applied to such pulp in a dosage range of up to about 3% based on the weight of oven dried pulp, with a preferred range of from about 0.5% to about 1%. The bleaching operation is usually carried out at a pulp consistency in the range of from about 2% to about 12%, with a preferred consistency range of from about 3.5% to about 4.5%. A bleaching pH range of from about 4.5 to about 6.5 offers a compromise between acid catalyzed decomposition of the sodium hydrosulfite and effective brightening and therefore is preferred. A more preferred bleaching pH is in the range of from about 5.0 to about 6.0. Typically, bleaching is conducted at a temperature of from about 50° F. to about 70° F., with a preferred bleaching temperature of from about 55° F. to about 65° F. The bleaching retention time is preferably from about 30 to about 120 minutes and more preferably from about 55 minutes to about 65 minutes.

The pulp from the thermomechanical pulping and bleaching process is used in the paper making process. In the paper making process, the bleached aspen pulp is formulated into an aqueous paper making stock furnish which also comprises an aluminum based additive which imparts or enhances specific sheet properties or which control other process parameters. Illustrative of such aluminum based additives is alum which is used to control pH, fix additives onto pulp fibers and improve retention of the pulp fibers on the paper making machine. Other aluminum based chemicals which may be added to the furnish are sodium aluminate, poly aluminum silicate sulfate and poly aluminum chloride. Other wet end chemicals which may be included in the paper making stock furnish for conventional purposes are acid and bases, sizing agents, dry-strength resins, wet strength resins, fillers, coloring materials, retention aids, fiber flocculants, defoamers, drainage aids, optical brighteners, pitch control chemicals, slimicides, biocides, specialty chemicals such as corrosion inhibitors, flame proofing and anti-tarnish chemicals, and the like. Methods and procedures for formulating thermomechanical bleached pulp, aluminum based wet end chemicals and other optional wet end chemicals are well known in the art and will not be described in any great detail. See for example, *Pulp and Paper Manufacture, Pulp and Paper Chemistry and Pulp Bleaching*.

The aqueous paper making stock furnish comprising the bleached mechanical pulp and the aluminum based compounds is deposited onto the forming wire of a conventional paper making machine to form a wet deposited web of paper and the wet deposited web of paper is dried to form a dried web of paper having the desired yellowing characteristics. Paper making machines and the use of same to make paper are well known in the art and will not be described in any great detail. See for example, *Pulp and Paper Chemistry*. By way of example, the aqueous paper making stock furnish containing pulp, aluminum based and other optional additives and usually having a consistency of from about 0.3% to about 1% is deposited from the head box of a suitable paper making machine as for example a twin or single wire fourdrinier machine. The deposited paper making stock furnish is dewatered by vacuum in the forming section. The dewatered furnish is conveyed from the forming section to the press section on specially-constructed felts through a series of roll press nips which removes water and consolidates the wet web of paper and thereafter to the dryer section where the wet web of paper is dried to form the dried web of paper of this invention. After drying, the dried web of paper may be optionally subjected to several dry end operations such as and various surface treatments such as coating, and sizing and calendering.

The dried web of this invention exhibits reduced yellowing as compared to a dried web of paper manufactured under the same conditions but using bleached thermomechanical aspen pulp which was not washed before the bleaching stage. The reduction in yellowing is at least about 25%, preferably at least about 50%, more preferably about 75% and most preferably greater than about 90%.

The paper manufactured in accordance with this invention can be used for conventional purposes. For example, the paper is useful as publication paper, newsprint and the like.

The present invention is described in more detail by referring to the following Examples and comparative Examples which are intended to more practically illustrate the invention and not to be a limitation thereon.

EXAMPLE I

Referring to the drawings, FIG. 1 depicts a preferred embodiment 10 of the pulping process of the invention. Numerals 12, 14 and 16 denote storage bins for lignocellulose containing starting materials, e.g. wood chips. At least one of storage bins 12, 14 and 16 contains aspen chips in an amount such that the total percentage of aspen chips present is from about 50% to about 100% based upon the total amount of chips in bins 12, 14 and 16. The chips are conveyed from bins 12, 14 and 16 via lines 18, 20 and 22, respectively, by some conveying means (not depicted) to steam treatment vessels 24, 26 and 28 where they are pretreated with steam supplied from a source not shown to a temperature equal to or greater than the softening point of lignin preferably from about 145° C. to about 150° C. The pretreated chips are conveyed from vessels 24, 26 and 28 by some conveying means (not depicted) to primary refiner 30 via lines 32, 34 and 36. In primary refiner 30, the wood chips are subjected to mechanical attritional forces at elevated pressure and temperature, and at a power and for a time sufficient to cause substantial fiber separation. Typically, any device known in the art capable of imparting attritional forces under the desired conditions of temperature and pressure can be employed in the primary refining step. Generally, however, a disc or conical refiner is used. Preferably, the refiner is a steam-pressured disc-refiner or double-disc-refiner, such as, for example a Bauer Model No. 418 pressured double-disc-refiner made by A-S Bauer of Springfield, Ohio. Optionally the chips may be treated with other chemicals prior to the primary refining stage or preferably during the primary refining stage as for example treated with a sulfite chemical, a bleaching agent such as sodium dithionite introduced into primary refining stage 30 via line 38.

After the wood chips have been refined the desired extent, fibrillated wood fiber can be conveyed from the primary refiner 30 directly to the washing stage 60 via lines 46 and 48, or preferably can be conveyed to secondary refiner 50 via lines 46 and 52 for further refining. Prior to a subsequent secondary refining 50, the fibrillated wood chips can be treated with chemicals or wood fiber treatment agents which interact on wood fiber characteristics which are introduced into secondary refining stage 50 via line 54.

In secondary refiner 50, the fibrillated wood chips are subjected to further refining usually at substantially atmospheric or autogenous temperature and pressure to provide a pulp having the desired freeness and fiber length. Any conventional device or technique which will provide a pulp of the desired freeness and fiber length can be employed. Such useful secondary refining devices and techniques are well known in the art. See for example, *Pulp and Paper Manufacture, Pulp and Paper Chemistry and Pulp Bleaching*, supra.

Accordingly, useful secondary refining devices and techniques will not be described herein in any great detail. After treatment in secondary refiner 50, the refined pulp is conveyed via line 62 to washing stage 60 where the pulp is washed under conditions sufficient to provide the desired results. Any conventional washer or washing process can be used. Illustrative of such washers and washing processes are those described in *Pulp and Paper Manufacture*. In the preferred embodiments of the invention, the washer is a decker.

After washing, the washed pulp is conveyed via line 62 to pulp bleaching which is generally denoted by the number 56 where the pulp is bleached to the desired extent. The chemicals or conditions for bleaching thermomechanical pulp are well know in the art, see for example, *Pulp and Paper Manufacture and Pulp Bleaching*.

All of these conventional procedures can be used. Pulp bleaching 56 may consist of a single bleaching stage or may be a series of bleaching stages using the same or different bleaching agents. As depicted in FIG. 1, pulp bleaching 56 consists of a series of two bleaching stages 40 and 42. In the first bleaching stage, the pulp is bleached with a conventional bleaching agent which is sodium dithionite or hydrogen peroxide introduced into bleaching stage 40 via line 66 for a time and when conditions sufficient to produce a pulp having the desired level of brightness. The first bleached pulp is then conveyed via line 64 to second bleaching stage 42 where the first bleached pulp is preferably bleached with the other remaining bleach chemicals introduced into bleaching stage 42 via line 60 to form a second bleached pulp which is conveyed to a suitable paper making machine via line 72.

Pulps made in accordance with the present invention may be made into a variety of conventional paper products using standard paper making techniques. It has been found that the standard paper making techniques as described by the Technical Association of the Paper and Pulp Industry (TAPPI) which are known to work with mechanically refined pulps work equally well with the pulps prepared in accordance with the present inventions. Accordingly, paper may be made from the pulp of this invention using conventional methodology. The paper prepared from the pulps of the present invention compare favorably in quality, strength, color and texture to paper prepared from the pulps of the prior art.

Figure 2:
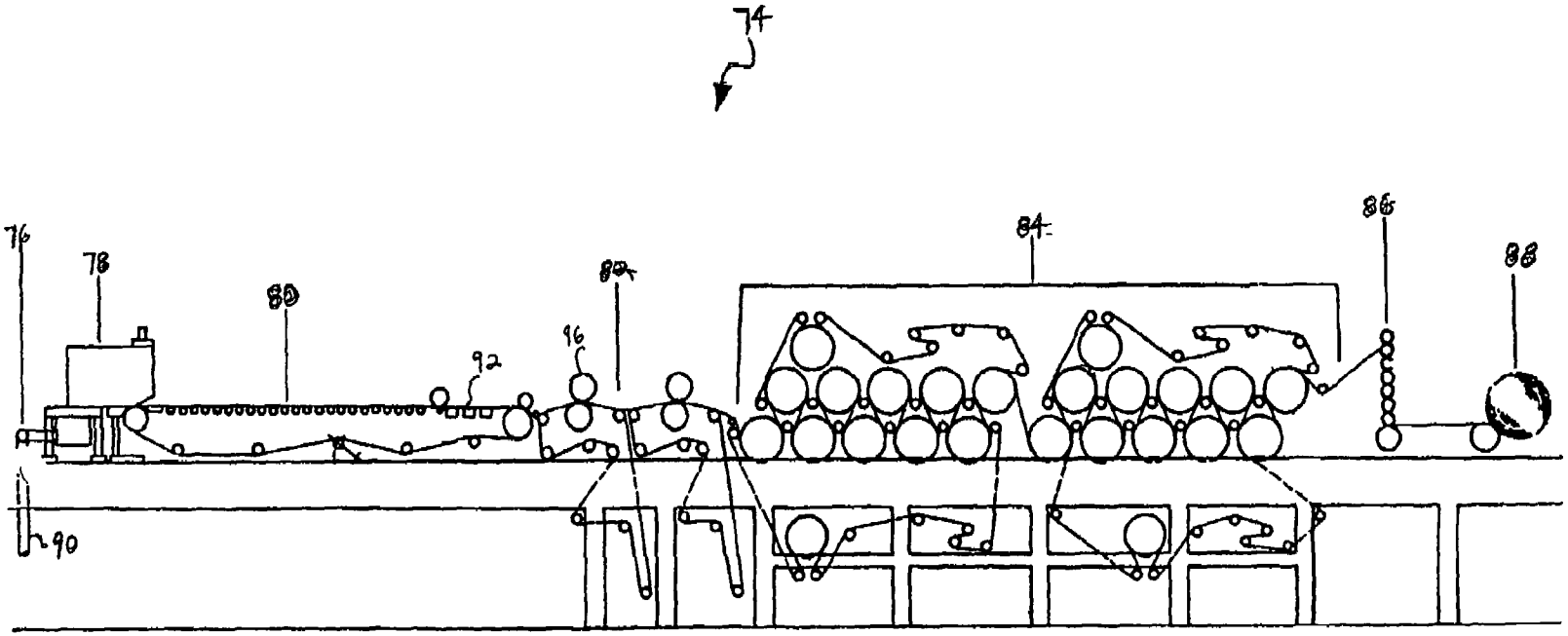
FIG. 2 depicts schematically a preferred paper forming process of this invention.

Referring to FIG. 2, the reference numeral 74 denotes a preferred paper making machine for making paper from pulp of this invention on and the paper making process of this invention. Paper making machine 74 includes a flow spreader 76, a head box 78, fourdrinier or twin wire table 80, press section 82, dryer section 84, calendering stack 86 and reel 88. As shown in FIG. 3, paper stock comprising water, thermomechanical aspen pulp, kraft pulp and one or more aluminum compounds are fed to flow spreader 76 via pipeline 90 from a pulp stock storage tank (not depicted). Flow spreader 76 distributes pulp stock flow evenly across the latitudinal axis of the machine. The evenly distributed pulp stock flow is introduced into a head box 78 which discharges a uniform jet of paper making stock onto the moving forming wire of the fourdrinier forming table. The forming wire is a porous woven support surface which moves along an endless path of travel entrained over various rollers. The forming wire forms the fiber into a continuous matted web while the fourdrinier table drains the water from the web by suction force. The wet web then passes through the press section through a series of roll presses where additional water is removed and the web structure is consolidated. The consolidated web is then conveyed to dryer section 84 where the web is dried by contact with a series of steam heated cylinders which remove most of the remaining water by evaporation and develop fiber-to-fiber bonds. The dried sheet of web is conveyed to calender stack 86 where the dried web is calendered through a series of roll nips which reduce web thickness and increases web smoothness. The dried, calendered web or sheet is then accumulated by winding onto reel 88.

EXAMPLE II

For the washing/alum yellowing tests, four oven dried (OD) pulp samples (3 grams of 50/50 Aspen/Spruce Fir) at 4% consistency were placed in glass beakers at 4% in a water bath at 150° F. The pulps were allowed to warm, making sure that they were at 150° F. for 15 minutes. One sample was then removed from the water bath, and 250 mls of room temperature distilled (DI) water were added The sample was then stirred and allowed to sit for at least 15 minutes. The sample was then stirred and suctioned down on a 9 cm #4 smooth filter pad in a fritted glass Buchner funnel, and placed sample down on a TAPPI brightness plate. This sample is designated "Sample A". The next sample was removed from the water bath, four mls of 1% alum solution added, and the sample stirred. Then 250 mls room temperature DI water were added and the sample stirred again. After at least 15 minutes, the sample was suctioned into a brightness pad as above. This sample is designated "Sample B".

Three hundred sixty milliliters (360 mls) of 70° C. to 75° C. DI water were added to the next pulp sample while still in the water bath. This sample was then stirred for two minutes, removed from the water bath and filtered to 10% consistency. To this sample 45 mls of room temperature fresh water were added, followed by 4 mls of a 1% alum solution. The sample was stirred. After stirring, 250 mls of room temperature DI water were added. The sample was then stirred and let stand for at least 15 minutes. The sample was then made into a brightness pad as above. This sample is designated "Sample C".

For the last sample, 360 mls of room temperature DI water were added and the sample stirred for two minutes while in the water bath. The sample was then removed from the water bath and filtered to 10% consistency. Then, 45 mls of room of temperature fresh water were added, followed by four mls of 1% alum solution. The sample was then stirred. To this sample, 250 mls of room temperature DI water were added, the sample stirred and made into a brightness pad as above. This sample is designated "Sample D".

All pads were then pressed in a TAPPI standard press on cycle two, allowed to condition overnight and tested for ISO brightness. The results are set forth in the following Table 1.

TABLE 1

| SAMPLE | ISO BRIGHTNESS |
|---|---|
| Sample A | 59.7 |
| Sample B | 56.4 |
| Sample C | 60.2 |
| Sample D | 58.6 |

EXAMPLE III

A washing/bleaching study was conducted on thermomechanical pulp to determine how the location of washing impacts the yellowing effect caused by the interaction of alum with aspen wood pulp. Belt press washing was compared to washing by deckers and disk filters. The pulp used for this study was a 50/50 blend of aspen wood and fir pulp sampled at the tertiary refiner, unscreened and uncleaned. One stage bleaching ("One Stage") with sodium dithionate as depicted in FIG. 2 and two stage bleaching ("Two Stage") with hydrogen peroxide and sodium dithionate were simulated. For the One Stage Process, pulp (~25% consistency) was diluted with fresh water at 150° F. for 15 minutes to either 4.5% consistency for bleaching or 0.7% for prewashing. The pre-washed pulp was thickened back to 10% consistency, rediluted with hot fresh water and then bleached. PH before bleaching was in the 5–6 range. Conditions were 4% consistency, 140° F., 1 hour with 1% Vbrite 515 (sodium dithionite bleach agent available commercially from Clariant). Filtrates were tested for suspended and dissolved solids, acidity pH and chemical oxygen demand ("COD").

For the Two Stage Process, an additional 5# DTPA chelating agent manufactured and sold by Dow Chemical Company under the tradename "Versenex" was added prior to bleaching. Pulp (~25% consistency) was diluted with 150° F. water to 4.5% and the chelant added. After 15 minutes of stirring, the slurry was passed through a screw press every five minutes to reach 33% consistency. The filtrate was saved both for testing and to use for re-dilution. For pre-washing, pulp was initially diluted to 0.7% consistency, thickened to 10% and re-diluted as above. The pulps were bleached in the Quantum with a liquor consisting of 0.05% DTPA chelating agent, 0.15% XUS (a chemical manufactured and sold by Dow Chemical Company under the tradename "Versenate"), 2.77% NaOH, and 2.15% $H_2O_2$. After initial trials, the retention time was altered from 5 to 3 hours at 150° F. to ensure peroxide residual. The pulp was split and diluted half with 140° F. fresh water and half with the prior filtrate (kept warm). Both were neutralized with sulfurous acid to a pH of 5.5 at a consistency at 4.5% for 30 minutes, and then bleached with 0.8% hydrogen peroxide as above. The results are set forth in the following Tables 2 and 3.

TABLE 2

WASHING/YELLOWING STUDY - TWO STAGE BLEACHING

| WASHING LOCATION | BRIGHTNESS IMPROVEMENT | ANIONIC TRASH IMPROVEMENT |
|---|---|---|
| PRE[a] | 1.2 | 20% |
| INTER[b] | 1.5 | 9% |
| POST[c] | 0.4 | 78% |
| PRE + INTER[d] | 2.8 | 31% |
| PRE + POST[e] | 1.0 | 84% |
| INTER + POST[f] | 1.7 | 84% |
| PRE + INTER + POST[g] | 3.0 | 84% |

TABLE 3

WASHING/YELLOWING STUDY - ONE STAGE BLEACHING

| WASHING LOCATION | BRIGHTNESS IMPROVEMENT | ANIONIC TRASH IMPROVEMENT |
|---|---|---|
| PRE[(a)] | 1.5 | 72% |
| POST[(c)] | 0.7 | 80% |
| PRE + POST[(e)] | 2.2 | 93% |

In the Tables, the abbreviations have the following meanings:

(a) "PRE" is washing before any distinct bleaching stage;
(b) "INTER" is washing between the two stages of a two stage bleaching process;
(c) "POST" is washing after all bleaching is completed;
(d) "PRE+INTER" is a combination of (a) and (b);
(e) "PRE+POST" is a combination of (a) and (c);
(f) "INTER+POST" is a combination of (b) and (c); and
(g) "PRE+INTER+POST" is a combination of (a), (b) and (c)

Since many changes and variations of the disclosed embodiments of the invention may be made without departing from the inventive concept, the specific examples are not intended to limit the invention except as required by the appended claims.

What is claimed is:

1. A process for forming bleached thermomechanical bleached aspen pulp having reduced yellowing when subsequently treated with aluminum based chemicals, said process comprising the steps of: (a) a thermomechanical refining stage wherein aspen wood chips are thermomechnically refined to form thermomechanical refined aspen wood pulp; and (b) a bleaching stage wherein said thermomechanical refined aspen wood pulp is bleached in one or more bleaching stages to form a first bleached thermomechanical refined aspen wood pulp; the improvement comprising a washing stage subsequent to said thermomechanical refining stage wherein said thermomechanical refined aspen wood pulp, bleached thermomechanical refined aspen wood or a combination thereof is washed at least once with an aqueous liquid composition, wherein on subsequent treatment of said bleached thermomechanical refined aspen wood pulp with at least one aluminum based chemical said first bleached thermomechanical refined aspen wood pulp has a higher ISO brightness than a second bleached thermomechanical aspen wood pulp formed by the same or substantially the same process as said first bleached thermomechanical refined aspen wood pulp in the absence of said washing stage.

2. The process according to claim 1 wherein said aspen pulp is derived from aspen.

3. The process according to claim 1 wherein said thermomechanical aspen pulp is washed at a temperature equal to or greater than about 68° F.

4. The process of claim 3 wherein said temperature is from about 68° F. to about 212° F.

5. The process of claim 4 wherein said temperature is from about 80° F. to about 180° F.

6. The process of claim 5 wherein said temperature is from about 90° F. to about 170° F.

7. The process of claim 6 wherein said temperature is from about 100° F. to about 165° F.

8. The process of claim 7 wherein said temperature is from about 120° F. to about 160° F.

9. The process of claim 1 wherein said pulp is washed prior to said bleaching stages.

10. The process of claim 1 wherein said pulp is washed after said bleaching stages.

11. The process of claim 1 wherein said process comprises more than one bleaching stage.

12. The process of claim 11 wherein said pulp is washed prior to said bleaching stage.

13. The process of claim 11 wherein said pulp is washed at lest once between bleaching stages.

14. The process of claim 12 wherein said pulp is washed at least once between bleaching stages.

15. The process of claim 1 wherein said at least one aluminum based chemical is selected from the group consisting of alum, sodium alummate, polyaluminum silicate sulfate and polyaluminum chloride.

16. The process of claim 15 wherein said at least one aluminum based chemical is alum.

17. The process of claim 1 wherein said first bleached thermomechanical pulp has an ISO brightness of at least about 0.5 units greater than that of the second bleached thermomechanical pulp.

18. The process of claim 17 wherein said first bleached thermomechanical pulp has an ISO brightness of at least about 1.0 units greater than that of the second bleached thermomechanical pulp.

19. The process of claim 18 wherein said first bleached thermomechanical pulp has an ISO brightness of at least about 1.5 units greater than that of said second bleached thermomechanical pulp.

20. The process of claim 19 wherein said first bleached thermomechanical pulp has an ISO brightness of at least about 2.0 units greater than that of said second bleached thermomechanical pulp.

* * * * *